United States Patent [19]

Igarashi et al.

[11] Patent Number: 4,507,057

[45] Date of Patent: Mar. 26, 1985

[54] CONTROL SYSTEM FOR HYDRAULIC PUMPS OF A CIVIL MACHINE

[75] Inventors: Michiaki Igarashi, Yokosuka; Takayasu Inui, Hirakata; Kazuo Otsuka, Hirakata; Saburo Nogami, Hirakata; Satoru Nishimura, Hirakata, all of Japan

[73] Assignee: Kabushiki Kaisha Komatsu Seisakusho, Tokyo, Japan

[21] Appl. No.: 467,961

[22] Filed: Feb. 18, 1983

Related U.S. Application Data

[62] Division of Ser. No. 218,914, Dec. 22, 1980.

[30] Foreign Application Priority Data

Jan. 7, 1980 [JP] Japan ..... 55-449

[51] Int. Cl.[3] ..... F04B 49/00

[52] U.S. Cl. ..... 417/216; 60/443; 60/452; 60/486; 417/218

[58] Field of Search ..... 60/443, 444, 445, 452, 60/486; 417/218, 222, 219, 221, 216

[56] References Cited

U.S. PATENT DOCUMENTS

| | | | |
|---|---|---|---|
| 3,732,036 | 5/1973 | Busbey et al. | 417/216 |
| 3,788,775 | 1/1974 | Leutner et al. | 417/222 |
| 4,013,380 | 3/1977 | Pensa | 417/218 |
| 4,073,141 | 2/1978 | Lohbauer | 60/486 X |
| 4,077,744 | 3/1978 | Pensa | 417/218 |
| 4,103,489 | 8/1978 | Fletcher et al. | 60/448 X |
| 4,395,199 | 7/1983 | Izumi et al. | 417/222 X |

*Primary Examiner*—Edward K. Look

*Attorney, Agent, or Firm*—Spensley Horn Jubas & Lubitz

[57] ABSTRACT

A civil machine having a flow-rate controller which applies a preset signal instead of a normal flow-rate signal to a variable type hydraulic pump when delivery pressure of the hydraulic pump exceeds a preset pressure value. The normal flow-rate signal corresponds to the position of an operating lever. The preset signal has a value of minimum flow rate to hold a working tool in a certain posture. With this control system, pressure loss and temperature rise in hydraulic operating oil as well as fuel consumption of the machine can be reduced and cycle time of the work can be improved.

7 Claims, 10 Drawing Figures

CONTROL SYSTEM FOR HYDRAULIC PUMPS OF A CIVIL MACHINE

This is a division of application Ser. No. 06/218,914, filed on Dec. 22, 1980.

BACKGROUND OF THE INVENTION

This invention relates to a control system for hydraulic pumps of a hydraulic type civil machine.

In a conventional hydraulic type civil machine, for example in a conventional hydraulic power shovel, it is so constructed that a small number of hydraulic pumps drive such equipment as a boom cylinder 2, an arm cylinder 3, a bucket cylinder 4, a slewing motor 5 and a travelling motor 6 as shown in FIG. 1, whereby controlling working tools such as a boom 7, an arm 8 and a bucket 9 as well as controlling slewing and travelling of these working tools, and for the hydraulic circuit therein parallel circuits have been usually employed. As a result, hydraulic power loss is a considerable amount while an operating lever is set to the neutral position. In another conventional hydraulic power shovel, in order to meet a recent trend in which machines become large in size and in order to output hydraulic power equal to load being charged, a variable pump 11 is employed as shown in FIG. 2. In such a machine, an engine 10 drives a variable pump 11 and a control pump 12, and the control pump 12, in turn, actuates a mechanical cylinder 13 to control an inclination angle of a swash plate of the variable pump 11, thereby controlling flow rate of hydraulic operating oil to be fed into a manually operated directional control valve 14. The manually operated directional control valve 14 controls a working tool cylinder 16. Maximum pressure $P_2$ and maximum flow rate $Q_2$ (FIG. 3) are restricted by a relief valve 15 and the variable pump 11, respectively.

However, in such conventional control systems as described above, since they are of manual operation type, relief loss of oil pressure is very large when a hydraulic cylinder lies in the stroke end or when overload is charged during excavation. In this connection, referring to FIG. 3 and 4 which show relationship between pressure P and flow rate Q of hydraulic power, assign reference alphanumerals $PS_N$ and $PS_R$ to hydraulic power loss at the neutral condition and at an overload condition, respectively, then these values $PS_N$ and $PS_R$ are expressed by the following equations.

$$PS_N = \frac{P_1 \times Q_2}{450} \text{ (H-P)} \quad (1)$$

$$PS_R = \frac{P_2 \times Q_1}{450} \text{ (H-P)} \quad (2)$$

Large relief loss of oil pressure causes temperature rise in hydraulic operational oil, which results in deterioration of hydraulic oil used as well as a higher rate of fuel consumption.

As described above, in a conventional hydraulic type civil machine, for example in a conventional hydraulic power shovel, a single engine drives a plurality of hydraulic pumps, which in turn drive a plurality of hydraulic motors and cylinders, thereby performing travelling and slewing of the machine as well as various kinds of excavation work.

Such a conventional hydraulic type civil machine is likely to suffer engine failure when raising the delivery pressure of the engine beyond the rated output capacity of the engine or using a plurality of hydraulic pumps simultaneously with their delivery pressure raised.

In order to prevent engine failure in such conventional power shovel, an operator must foresee it by always paying attention to troubled signs such as abnormal engine noise and engine speed reduction. Upon recognizing any troubled sign, the operator must return the operating lever to the neutral position so as to reduce the work load.

However, such system in which an operator foresees engine failure as described above is disadvantageous in that it depends upon operator's senses and therefore frequency of the engine failure depends upon operator's skill and work efficiency is lowered as well as operators are exhausted.

SUMMARY OF THE INVENTION

Accordingly, an object of this invention is to overcome the above-described disadvantages accompanying a conventional control system for hydraulic pumps of a hydraulic civil machine.

More specifically, an object of this invention is to provide a control system for hydraulic pumps of a hydraulic civil machine in which servo-type variable pumps are employed, delivery pressure of said variable pumps are detected, an inclination angle of a swash plate of said variable pumps is controlled to the minimum required degree when an operating lever is set to the neutral position, and when overload is charged during excavation as well as when a cylinder lies in a stroke end position, oil pressure relief is controlled, whereby hydraulic oil pressure loss is reduced.

Another object of this invention is to provide a control system for hydraulic pumps of a hydraulic type civil machine which enables to reduce fuel consumption and to prevent temperature rise in hydraulic operating oil because relief valves are not operated frequently, thereby longer life of hydraulic operating oil can be secured.

A further object of this invention is to provide a control system for hydraulic pumps of a hydraulic type civil machine in which even an unskilled operator can perform work without causing any engine failure, whereby cycle time can be improved and operator's fatigue alleviated.

A still further object of this invention is to provide a control system for hydraulic pumps of a hydraulic type civil machine in which flow rate and delivery pressure of each hydraulic pump are detected, current output torque of an engine is calculated from said flow rate and delivery pressure, and the flow rate of each hydraulic pump is decreased when said calculated current output torque exceeds the rated torque of the engine, whereby engine failure is prevented.

These and further objects, features and advantages of this invention will become more obvious from the following description when taken in connection with the accompanying drawings which show, for purposes of illustration only, one embodiment in accordance with this invention.

DETAILED DESCRIPTION OF THE INVENTION

Figure 5:
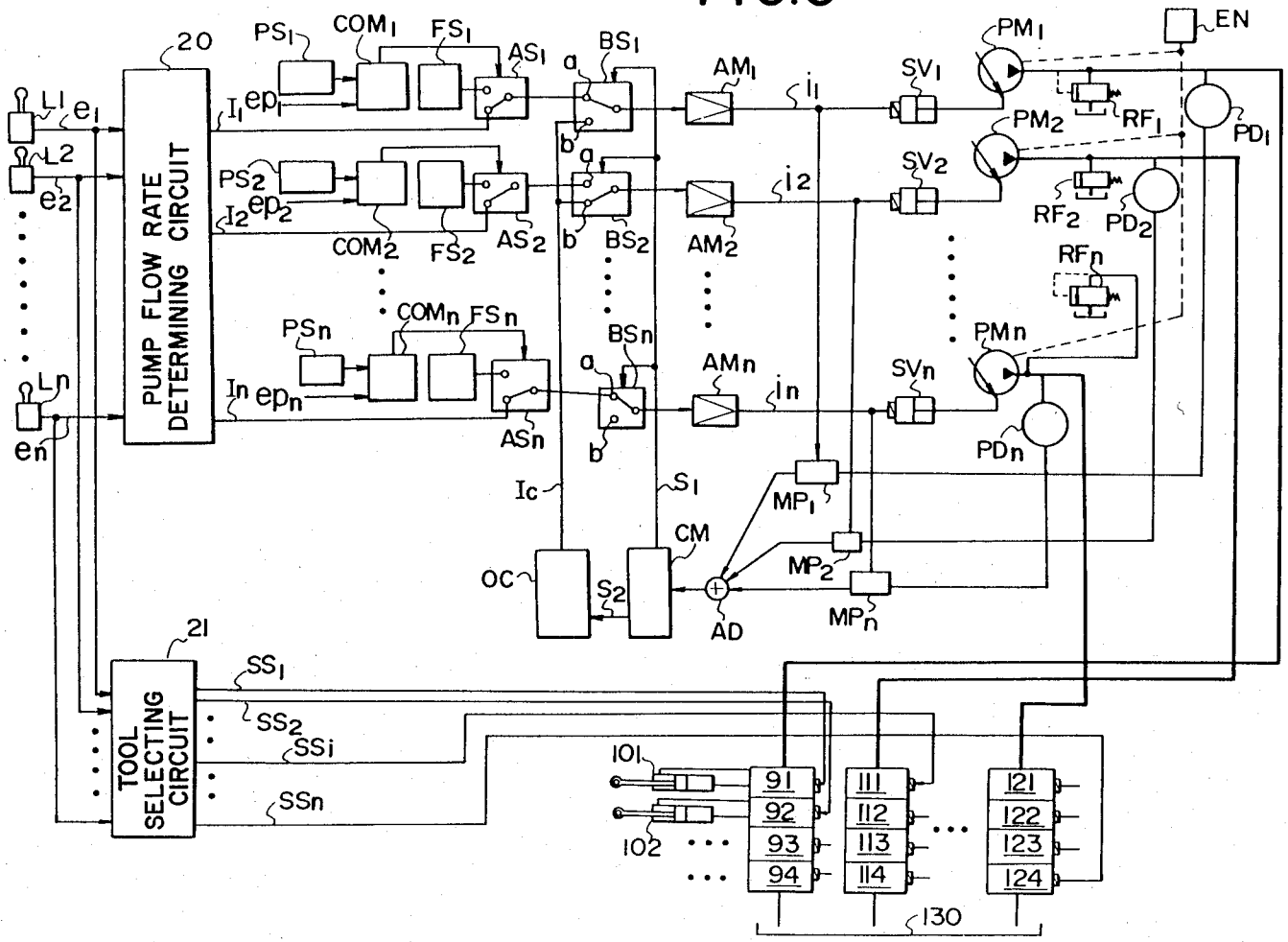
FIG. 5 is a block diagram showing a control system for hydraulic pumps of a hydraulic type civil machine according to one embodiment of this invention.
Figure 9:
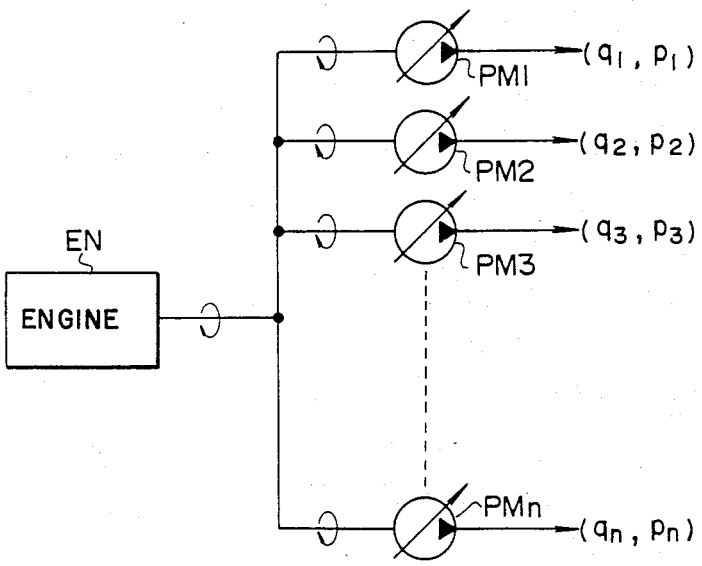
FIG. 9 is a block diagram showing a case according to this invention in which one engine drives a plurality of variable type hydraulic pumps.

Referring now to the drawings, and more particularly to FIG. 5 which shows a control system for hydraulic pumps according to this invention, an Engine EN drives servo-type variable pumps $PM_1$ to $PM_n$. Flow rate $q_l$ to $q_n$ of variable pumps $PM_1$ to $PM_n$ varies with inclination angles of swash plates in these variable pumps $PM_1$ to $PM_n$, respectively. Hydraulic operating oil delivered from these variable pumps $PM_1$ to $PM_n$ is fed, through directional control valves 91 to 94, 111 to 114, . . . , 121 to 124, into working tool cylinders 101, 102 . . . of n units in total and performs extending and retracting controls on these working cylinders 101, 102, . . .

These directional control valves 91 to 94, . . . , 121 to 125 construct four-coupled tandem valves of n units. Output operating oil from the directional control valves 91 to 94, . . . , 121 to 124 is applied to the working tool cylinders 101, 102, . . . (n units in total), in the predetermined combination of the directional control valves. This hydraulic circuit is indicated in FIG. 5 in an abbreviated manner.

Operating levers $L_1$ to $L_n$ are of an electrical type and produce signals $e_1$ to $e_n$ whose magnitude and polarity are in accordance with an operational angle and direction of these levers.

A pump flow rate determining circuit 20 outputs pump flow rate command signals $I_1$ to $I_n$ corresponding to the magnitude of said signals $e_1$ to $e_n$.

Pressure detectors $PD_1$ to $PD_n$ are for detecting delivery pressure $p_1$ to $p_n$ of the pumps $PM_1$ to $PM_n$ and apply electrical pressure signals $ep_1$ to $ep_n$ for these delivery pressure $p_1$ to $p_n$ to one of the two input terminals of comparators $COM_1$ to $COM_n$, respectively.

Pressure setters $PS_1$ to $PS_n$ are for setting maximum delivery pressure $pk_1$ to $pk_n$ for the variable pumps $PM_1$ to $PM_n$ and output preset pressure signals corresponding to the respective maximum delivery pressure. These maximum delivery pressure $pk_1$ to $pk_n$ are respectively set in advance to predetermined values lower than relief pressure of relief valves $RF_1$ to $RF_n$.

Figure 6:
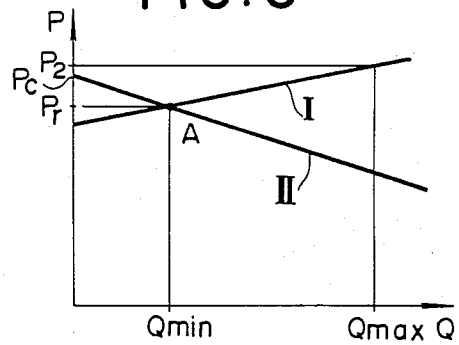
FIG. 6 is a graphical representation for the override characteristic curve and pressure setting characteristic curve.

In setting the maximum delivery pressure, for example $pk_1$, first draw a relief valve over-ride characteristic curve I for the relief valve as shown in FIG. 6 and determine maximum flow rate Qmax of the variable pump $PM_1$ corresponding to relief pressure $P_2$ which is determined by the corresponding hydraulic circuit and minimum flow rate Qmin necessary for holding the corresponding working tool in a certain fixed posture. Next, determine point A on the curve I which gives the minimum flow rate Qmin and assign Pr to the pressure corresponding to the point A. Then draw a straight line II which connects between the point A and the point representing a predetermined pressure Pc which is slightly lower than the relief pressure. The line II is called the electronic control pressure setting characteristic curve. For any of the maximum delivery pressure $pk_2$ to $pk_n$, the same as described above takes place.

The pressure detectors $PD_1$ to $PD_n$ detect delivery pressure $p_1$ to $p_n$ of the variable pumps $PM_1$ to $PM_n$, produce the electric pressure signals $ep_1$ to $ep_n$ corresponding to the delivery pressure $p_1$ to $p_n$ and applies the electric pressure signals $ep_1$ to $ep_n$ to comparators $COM_1$ to $COM_n$, respectively.

The comparator, for example $COM_1$, does not produce any output signal when input signal $ep_1$ is smaller than said preset pressure signal from the pressure setter $PS_1$ and therefore analog switch $AS_1$ remains the same state as shown in FIG. 5. When the input signal $ep_1$ exceeds the preset pressure signal, a signal is output to switch the corresponding analog switch $AS_1$ to the position opposite to that as shown in FIG. 5. For any of comparators $COM_2$ to $COM_n$, the same as described above takes place.

Figure 7:
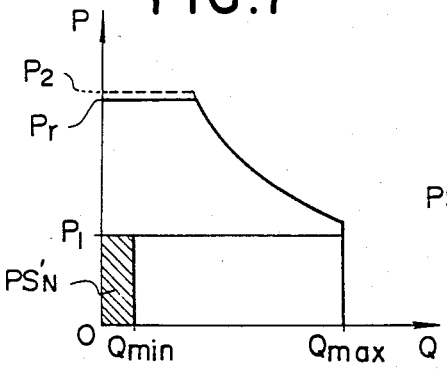
FIG. 7 is a graphical representation in which hydraulic power loss in the neutral position of an operating lever according to this invention is shown in the shaded portion.
Figure 8:
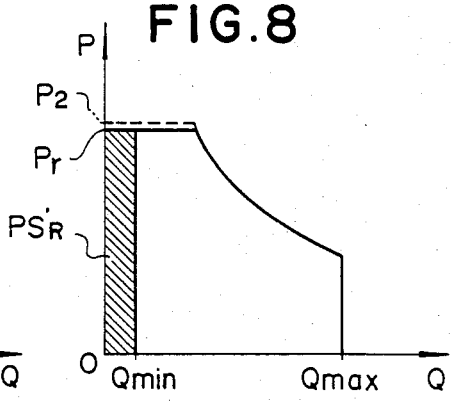
FIG. 8 is a graphical representation in which hydraulic power loss in an overloaded condition according to this invention is shown in the shaded portion.

Flow-rate setters $FS_1$ to $FS_n$ are for setting the respective minimum flow rate, (indicated as Qmin in FIGS. 7 and 8).

A servo amplifier, for example $AM_1$, amplifies input signal thereto and applies the amplified signal to a servo valve $SV_1$. Each servo valve $SV_1$ to $SV_n$ shown In FIG. 5 is the type of servo which is a reciprocating motor controlled by a proportional type solenoid. The servo valve $SV_1$ is controlled according to the input current $i_1$ and controls, in turn, the inclination angle of the swash plate in the pump $PM_1$. For any of servo amplifiers $AM_2$ to $AM_n$, the same as described above takes place.

Figure 1:
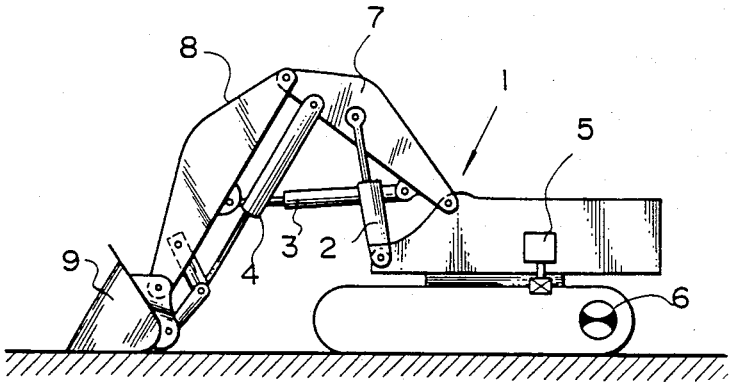
FIG. 1 PRIOR ART
FIG. 1 is a schematic illustration showing the arrangement of a hydraulic power shovel in the prior art.
Figure 2:
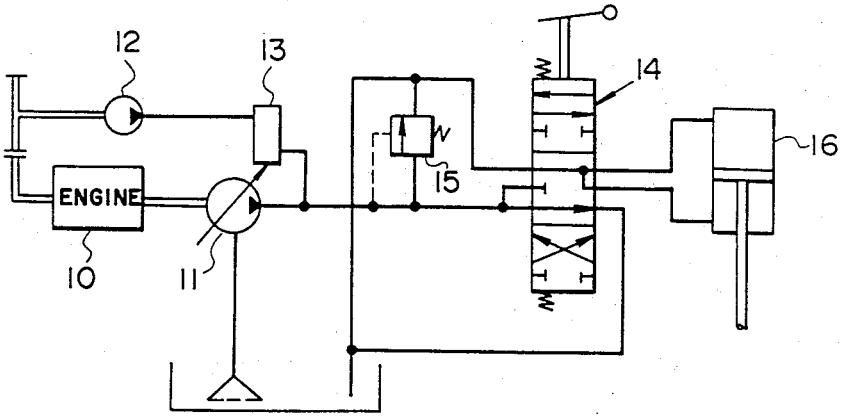
FIG. 2 PRIOR ART
FIG. 2 is a block diagram showing a control system in the prior art in which a variable type hydraulic pump is employed.
Figure 3:
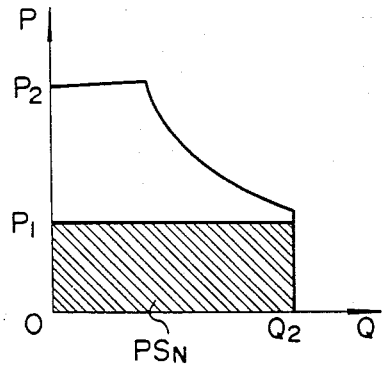
FIG. 3 PRIOR ART
FIG. 3 is a graphical representation showing relationship between delivery pressure and flow rate of a hydraulic pump in the prior art in which hydraulic power loss in the neutral position of an operating lever is indicated in the shaded portion.

When an operating lever, for example $L_1$, is set to the neutral position, output $I_1$ of the pump flow rate determining circuit 20 becomes zero. Meanwhile, as output signal of the comparator $COM_1$ is zero, then the servo valve $SV_1$ returns by a spring and the swash plate is set free. Therefore, the inclination angle of the swash plate of the variable pump $PM_1$ is minimized and flow rate of said variable pump $PM_1$ reaches the minimum value of Qmin. (See FIG. 7.) Hydraulic power loss $PS_N'$ at this time is indicated as the shaded portion in FIG. 7, which is reduced to a small fraction of power loss $PS_N$ as shown in FIG. 3. In case that any of the operating levers $L_2$ to $L_n$ is set to the neutral position, the same as described above takes place.

During excavation, the signal $I_1$ is assumed to be produced corresponding to the movement of the operating lever $L_1$. The servo valve $SV_1$ is then actuated in response to signal $I_1$ and extents the corresponding cylinder, thereby increasing the inclination angle of the swash plate. As a result, flow rate $q_1$ of the variable pump $PM_1$ is hightened, thereby a cylinder 91 is extended and excavation work starts.

Then, flow rate $q_1$ of the variable pump $PM_1$ increases corresponding to the operational angle of the operating lever $L_1$ and thereby delivery pressure $P_1$ is hightened. As long as the delivery pressure $P_1$ is lower than the minimum delivery pressure $pk_1$, flow rate $q_1$ of the variable pump $PM_1$ increases according to the operational angle of the operating lever $L_1$ and the cylinder 91 is driven thereby.

During excavation, if the working tool becomes overloaded or the cylinder 91 reaches to the stroke end, delivery pressure $p_1$ of the variable pump $PM_1$ increases. When this delivery pressure $p_1$ comes to exceed the maximum delivery pressure $pk_1$, an output signal is produced by the comparator $COM_1$ and thereby the analog switch $AS_1$ is turned to the position opposite to that as shown in FIG. 5.

Figure 4:
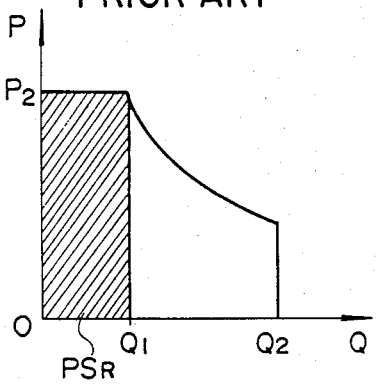
FIG. 4 PRIOR ART
FIG. 4 is a graphical representation showing relationship between delivery pressure and flow rate of a hydraulic pump in the prior art in which hydraulic power loss in an overloaded condition is indicated in the shaded portion.

As a result, the servo valve $SV_1$ is controlled to the position corresponding to the output signal of the flow rate setter $FS_1$ and flow rate $q_1$ decreases to Qmin. (See FIG. 8.) Hydraulic power loss $PS_R'$ in this condition is indicated as the shaded portion in FIG. 8, which is reduced to a small fraction of hydraulic power loss $PS_R$ in prior art. (See FIG. 4.) In response to the decrease, flow rate of hydraulic operating oil decreases and accordingly excavating power also decreases. When delivery pressure $p_1$ of the variable pump $PM_1$ becomes lower than maximum delivery pressure $pk_l$, control by means of the operating lever $L_1$ again becomes possible, and therefore, flow rate $q_1$ of the variable pump $PM_1$ can become controlled by the lever $L_1$ and thereby control of the cylinder 91 by the lever becomes possible. For any of the operating levers $L_2$ to $L_n$, the same as described above takes place.

As is apparent from the above description, according to this invention, it becomes possible to lower the flow rate of the variable pumps in overloaded condition without actuating any relief valve. Incidentally, an experiment reveals that, when control is performed according to this embodiment, fuel consumption can be cut by approximately 15% compared with conventional methods of control.

According to this invention, flow rate of each hydraulic pump is controlled so that the output torque of an engine does not exceed the rated torque. The following is a description in connection with this point.

Let us explain a case in which output torque of an engine is calculated using flow rate Q and delivery pressure p of variable pumps.

In a case where a single engine EN drives a plurality of variable pumps $PM_1$ to $PM_n$, assign reference alphanumeral $q_1$ to $q_n$ and $p_1$ to $p_n$ to flow rate and delivery pressure of each of variable pumps $PM_1$ to $PM_n$, respectively. Then output torque T of the engine EN is expressed by the following expression.

$$T = k \sum_{i=1}^{n} p_i \cdot q_i \quad (3)$$

where k is a proportional constant.

Figure 10:
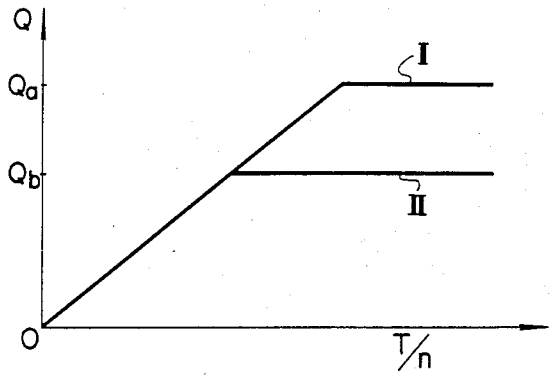
FIG. 10 is a graphical representation in which the maximum flow rate of a hydraulic pump according to this invention is shown by broken lines.

Therefore, by detecting the flow rate $q_1$ to $q_n$ and delivery pressure $p_1$ to $p_n$ of the variable pumps $PM_1$ to $PM_n$, output torque T of the engine EN can be calculated using equation (3). Even when the output torque exceeds the rated torque $T_0$, engine failure can be prevented by lowering the maximum flow rate Qmax of each variable pump from $Q_a$ as shown in broken line I of FIG. 10 to $Q_b$ in broken line II, thereby reducing torque T of the engine EN.

Referring to FIG. 5, it is so designed that in an ordinary state, i.e., when the torque of the engine EN does not exceed the rated torque $T_0$, analog switches $BS_1$ to $BS_n$ are set to side a of the switch contact and when signal $S_1$ from the comparator CM is applied, these switches $BS_1$ to $BS_n$ are switched to side b of the switch contact.

A working tool selecting circuit 21 outputs control signals $ss_1$ to $ss_n$ according to polarity of each signal $e_1$ to $e_n$, applies these control signals to the directional control valves 91 to 94, 111 to 114, . . . , 121 to 124 corresponding to the operating levers $L_1$ to $L_n$ and thereby switches each of these directional control valves to cylinder extending position or retracting position. (In this connection, each operating lever corresponds a plurality of the directional control valves. A part of signal transmitting channel for the directional control valves is indicated in FIG. 5.) Then working tool cylinders, e.g., a boom cylinder 101 and arm cylinder 102, are controlled in extending or retracting direction according to switched position of the directional control valves 91, 92, etc.

Pressure detectors $PD_1$ to $PD_n$ detect delivery pressure $p_1$ to $p_n$ of the variable pump $PM_1$ to $PM_n$ and produce pressure electric pressure signals $ep_1$ to $ep_n$ corresponding to these delivery pressure $p_1$ to $p_n$.

Multipliers $MP_1$ to $MP_n$ calculate flow rate $q_1(=k\times i_1)$, $q_2(=k\times i_2)$, . . . $q_n(=k\times i_n)$ of variable pumps $PM_1$ to $PM_n$ by multiplying the command current $i_1$ to $i_n$ by a proportional constant k and then calculate torque $T_1(=q_1\times p_1)$, $T_2(=q_2\times p_2)$, . . . $T_n(=q_n\times p_n)$ of variable pumps $PM_1$ to $PM_n$ by multiplying the above-calculated values $q_1$ to $q_n$ by electric pressure signal $ep_1$, $ep_2$, . . . , $ep_n$. These torque signals $T_1$ to $T_n$ are totalized into $T^*$ $(=T_1+T_2+ \ldots T_n)$ by means of an adder AD, which is applied to the comparator CM. Thus signal $T^*$ is the sum of torque $T_1$ to $T_n$ of the variable pumps $PM_1$ to $PM_n$ and has a value corresponding to output torque $T(=k\Sigma q_i p_i)$ of the engine EN.

The comparator CM compares input signal $T^*$ with preset value signal TK and outputs signals $S_1$ and $S_2$ when $T^*>TK$. This preset value signal TK has a value corresponding to the rated torque $T_0$ of the engine EN.

The operational circuit OC is for outputting the pump flow rate command signal when output torque T of the engine EN exceeds the rated torque $T_0(T^*>TK)$ and upon application of signal $S_2$ thereto, calculates maximum torque $T_c(=T_{0/n})$ which can be applied to each pump, outputs the command signal Ic corresponding to Tc and applies it to side b of the contact of each change-over switch $BS_1$ to $BS_n$. Meanwhile, each of the change-over switch $BS_1$ to $BS_n$ is switched from side a to side b by means of comparator output $S_1$. Then, instead of the signals $I_1$ to $I_n$ from the operating lever $L_1$ to $L_n$, the command signal Ic is applied, via servo amplifiers $AM_1$ to $AM_n$, to the servo valves $SV_1$ to $SV_n$. Then, flow rate $q_1$ to $q_n$ of variable pumps $PM_1$ to $PM_n$ is reduced to $Q_b$ which corresponds to command signal Ic. (See FIG. 10.) Therefore, output torque T of the engine EN becomes equal to the rated torque $T_0$, whereby said engine EN does not undergo any engine failure.

When, for instance, load on a working tool becomes reduced to such extent that output torque T of engine EN becomes smaller than the rated torque $T_0$, the comparator output $S_1$ and $S_2$ becomes zero, then the change-over switches $BS_1$ to $BS_n$ are switched to side a and the signals $I_1$ to $I_n$, instead of the command signal Ic, are applied to the servo valves $SV_1$ to $SV_n$. Then the flow rate of the variable pumps $PM_1$ to $PM_n$ come to be controlled in accordance with operation stroke of the operating levers $L_1$ to $L_n$.

As described above, in the system according to this embodiment, engine failure can be prevented by controlling flow rate of each of the variable pumps $PM_1$ to $PM_n$ so as to always keep said flow rate within the rated torque of the engine EN.

What is claimed is:

1. A control system for a plurality of variable type hydraulic pumps driven by an engine of a hydraulic type civil machine which has a plurality of servos, each servo being associated with a pump and responsive to a flow rate signal, for actuating a swash plate of the associated pump, said control system comprising:

detector means for producing a delivery pressure signal for each of the pumps, each delivery pressure signal being indicative of the delivery pressure of hydraulic fluid from an associated pump;

an operational circuit responsive to the detector means, for calculating the output torque of the engine on the basis of the pump delivery pressure signals from the detector means, and the flow rate signals applied to the servos;

a comparing circuit for comparing said output torque with a predetermined torque corresponding to the rated torque of the engine and for producing an output signal when said output torque exceeds said predetermined torque; and means responsive to the comparing circuit, for applying a predetermined flow-rate command signal to each servo when the comparing circuit provides said output signal so that the hydraulic pumps are driven within the rated torque of the engine.

2. A control system as claimed in claim 1 wherein said operational circuit comprises:

a plurality of multipliers for multiplying, for each hydraulic pump respectively, said delivery pressure signal of said detection means associated with said hydraulic pump by said flow-rate signal for the associated servo of said hydraulic pump; and an adder for adding the outputs- of each multiplier to each other.

3. A control system for a plurality of variable type hydraulic pumps driven by an engine of a hydraulic type civil machine in which a flow-rate signal corresponding to the position of an operating lever controls the flow-rate of a corresponding variable type hydraulic pump, said flow-rate signals being applied to servos, each of which controls an inclination angle of a swash plate of each said hydraulic pump, said control system comprising a first flow-rate controlling device which includes:

detector means for producing a delivery pressure signal for each of the pumps, each pressure delivery signal being indicative of the delivery pressure of hydraulic fluid from an associated pump;

an operational circuit responsive to the detector means, for calculating the output torque of the engine on the basis of the pump delivery pressure signals from the detector means, and the flow-rate signals applied to the servos;

a comparing circuit for comparing said output torque with a predetermined torque corresponding to the rated engine torque and for producing an output signal when said output torque exceeds the predetermined torque, and means responsive to the comparing circuit, for applying a predetermined flow-rate command signal to each servo when the comparing circuit provides said output signal, so that the hydraulic pumps are driven within said rated torque of said engine;

and said control system further comprising a second flow-rate controlling device for at least one of said hydraulic pumps, said second flow-rate controlling device being responsive to the detector means for applying a second predetermined signal having a value of a predetermined minimum flow-rate instead of said lever flow-rate signal to said one hydraulic pump when the delivery pressure signal for said one hydraulic pump exceeds a preset pressure value.

4. A control system is claimed in claim 3 wherein said second flow-rate controlling device comprises:

a comparator for comparing said delivery pressure signal with said preset pressure value and for producing an output signal when said delivery pressure signal exceeds said preset pressure value, a flow-rate setter for setting and outputting said second predetermined signal, and a change-over device which receives said lever flow-rate signal and said second predetermined signal as inputs-thereto for applying said second predetermined signal instead of a lever flow-rate signal to a servo of said one hydraulic pump when said comparator produces said comparator output signal.

5. A control system as claimed in claim 4 further comprising a plurality of said second flow-rate controlling devices, each second flow-rate controlling device being provided for an associated hydraulic pump.

6. A control system as claimed in claim 3 wherein said second predetermined signal is a signal corresponding to a predetermined minimum flow rate of said one hydraulic pump.

7. A control system as claimed in claim 3 wherein the hydraulic type civil machine has a relief valve provided in an output hydraulic circuit of said one hydraulic pump, said relief valve being actuated in response to the pressure in the output hydraulic circuit exceeding a predetermined relief pressure, wherein said preset pressure value is lower than said relief pressure.

* * * * *